US007021385B2

(12) United States Patent
Ohmer et al.

(10) Patent No.: US 7,021,385 B2
(45) Date of Patent: Apr. 4, 2006

(54) METHOD AND APPARATUS FOR CONTROLLING WELL PRESSURE IN OPEN-ENDED CASING

(75) Inventors: Herve Ohmer, Houston, TX (US); Ricardo M. Carossino, Stafford, TX (US); Jean-Marc Follini, Houston, TX (US); Mikhail V. Gotlib, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 136 days.

(21) Appl. No.: 10/294,080

(22) Filed: Nov. 14, 2002

(65) Prior Publication Data

US 2003/0066653 A1 Apr. 10, 2003

Related U.S. Application Data

(62) Division of application No. 09/733,226, filed on Dec. 8, 2000, now abandoned.

(51) Int. Cl.
*E21B 34/06* (2006.01)

(52) U.S. Cl. ..... 166/324; 166/322

(58) Field of Classification Search ..... 166/386, 166/339, 340, 322, 316, 325, 326, 324
See application file for complete search history.

(56) References Cited

U.S. PATENT DOCUMENTS

| | | | | | |
|---|---|---|---|---|---|
| 2,144,850 | A * | 1/1939 | Otis | 166/123 |
| 2,994,280 | A | 8/1961 | Daffin | 103/229 |
| 3,616,851 | A * | 11/1971 | Garcia | 166/317 |
| 4,129,184 | A | 12/1978 | Parker | 166/315 |
| 4,154,303 | A | 5/1979 | Fournier | 166/317 |
| 4,237,980 | A | 12/1980 | Robinson | 166/317 |
| 4,396,075 | A | 8/1983 | Wood et al. | 175/79 |
| 4,478,279 | A * | 10/1984 | Puntar et al. | 166/121 |
| 4,589,495 | A | 5/1986 | Langer et al. | 166/383 |
| 4,962,819 | A | 10/1990 | Bailey et al. | 175/218 |
| 5,501,280 | A | 3/1996 | Brisco | 166/373 |
| 5,842,521 | A | 12/1998 | Tetzlaff et al. | 166/369 |
| 5,857,521 | A | 1/1999 | Ross et al. | 166/296 |
| 5,944,107 | A | 8/1999 | Ohmer | 166/313 |
| 5,979,560 | A | 11/1999 | Nobileau | 166/381 |
| 5,996,711 | A | 12/1999 | Ohmer | 175/61 |
| 6,056,059 | A | 2/2000 | Ohmer | 166/313 |
| 6,070,667 | A | 6/2000 | Gano | 166/313 |
| 6,073,697 | A | 6/2000 | Parlin et al. | 166/313 |
| 6,079,495 | A | 6/2000 | Ohmer | 166/313 |
| 6,186,237 | B1 * | 2/2001 | Voss et al. | 166/337 |
| 6,244,342 | B1 | 6/2001 | Sullaway et al. | 166/285 |

* cited by examiner

*Primary Examiner*—David Bagnell
*Assistant Examiner*—Daniel P Stephenson
(74) *Attorney, Agent, or Firm*—Robert A. Van Someren; Brigitte L. Echols; Dale V. Gaudier

(57) ABSTRACT

A system and method for preventing blowouts during the deployment of a casing string into a wellbore. The system includes securing a casing coupling to a casing string and securing a retrievable check valve within the casing coupling. The retrievable check valve allows fluid from the surface to be pumped through the retrievable check valve. However, the retrievable check valve prevents upward fluid flow from the wellbore through the retrievable check valve to the surface.

17 Claims, 5 Drawing Sheets

METHOD AND APPARATUS FOR CONTROLLING WELL PRESSURE IN OPEN-ENDED CASING

This application is a Divisional of application Ser. No. 09/733,226, filed Dec. 8, 2000 now abandoned.

FIELD OF THE INVENTION

The present invention relates generally to a method and apparatus to prevent a well blowout during the installation of a casing string into a wellbore, and particularly to a retrievable check valve system utilized to prevent such a blowout.

BACKGROUND OF THE INVENTION

A typical production well consists of a wellbore lined with a wellbore casing. The casing is comprised of a string of tubular steel casing joints assembled together. As the casing string is lowered into the wellbore. Additional casing joints are added to the casing string until the wellbore is fully lined.

An imbalance of pressures in the wellbore may cause a blowout as the casing string is lowered into the wellbore. The pressure imbalance may result from a low pressure/high permeability formation in the open wellbore that causes gas to migrate to a column of fluid in the wellbore. If a blowout results, fluid flows toward the surface through the inside of the casing string.

A blowout may be prevented by placing a casing shoe check valve at the bottom of the casing string. However, the casing shoe check valve cannot be used in some applications, such as where the casing string is not hydraulically sealed above the valve. Another method utilizes a packer placed at the bottom, or close to the bottom, of the casing string. The packer includes a check valve and may support a stab-in cementing sleeve. However, this device permanently restricts access to the lower section of the casing and cannot be used where access is needed to place a tool near the bottom of the casing. Additionally, a wellbore may have several branches extending from a central vertical wellbore. In this event, a multi-branch junction is lowered into the wellbore to merge the branches into a single column. However, the casing shoe check valve and packer described above are unsuitable for use with a multi-branch junction.

If the conditions are suitable, the casing string may be lowered into the wellbore without any mechanism to prevent a blowout. However, even in this situation, some localities do not permit a casing string to be lowered into a wellbore without a mechanism in place to prevent a blowout.

It would be advantageous to have a flow control device readily useable with a casing string, especially a casing string having a multi-branch junction. Additionally, it would be advantageous to have a flow control device that could be retrieved quickly, easily, and completely once the casing string is disposed in the wellbore.

SUMMARY OF THE INVENTION

The present invention features a system for deploying casing into a wellbore. The system comprises a casing string and a deployment system for lowering the casing string into a wellbore. The system also comprises a check valve assembly that is securable to the casing string. The check valve assembly prevents blowouts by preventing fluid from flowing upward through the casing string. Also, the system is operable to release the check valve assembly from the casing string and to transport the check valve assembly to the surface location.

According to another aspect of the present invention, a system is featured for controlling well pressure in a wellbore during the insertion of a casing string. The system comprises a check valve assembly securable to the casing. One portion of the check valve assembly is a housing. A check valve is disposed within the housing to allow fluid to flow through the check valve assembly from a surface location. A sealing member is deployed to form a seal between the housing and the casing. Additionally, the check valve assembly has a securing member that is configured for engagement with the casing. The check valve assembly also has a releasing member that is operable to release the securing member from the casing.

According to another aspect of the present invention, a method of deploying casing into a wellbore is featured. The method comprises securing a blowout prevention assembly to a casing string. Additionally, the method comprises deploying the casing string in a wellbore. The method also comprises retrieving the blowout prevention assembly from the casing string after the casing string is deployed.

The above description of various aspects of the present invention is merely exemplary and is not intended to limit the scope of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
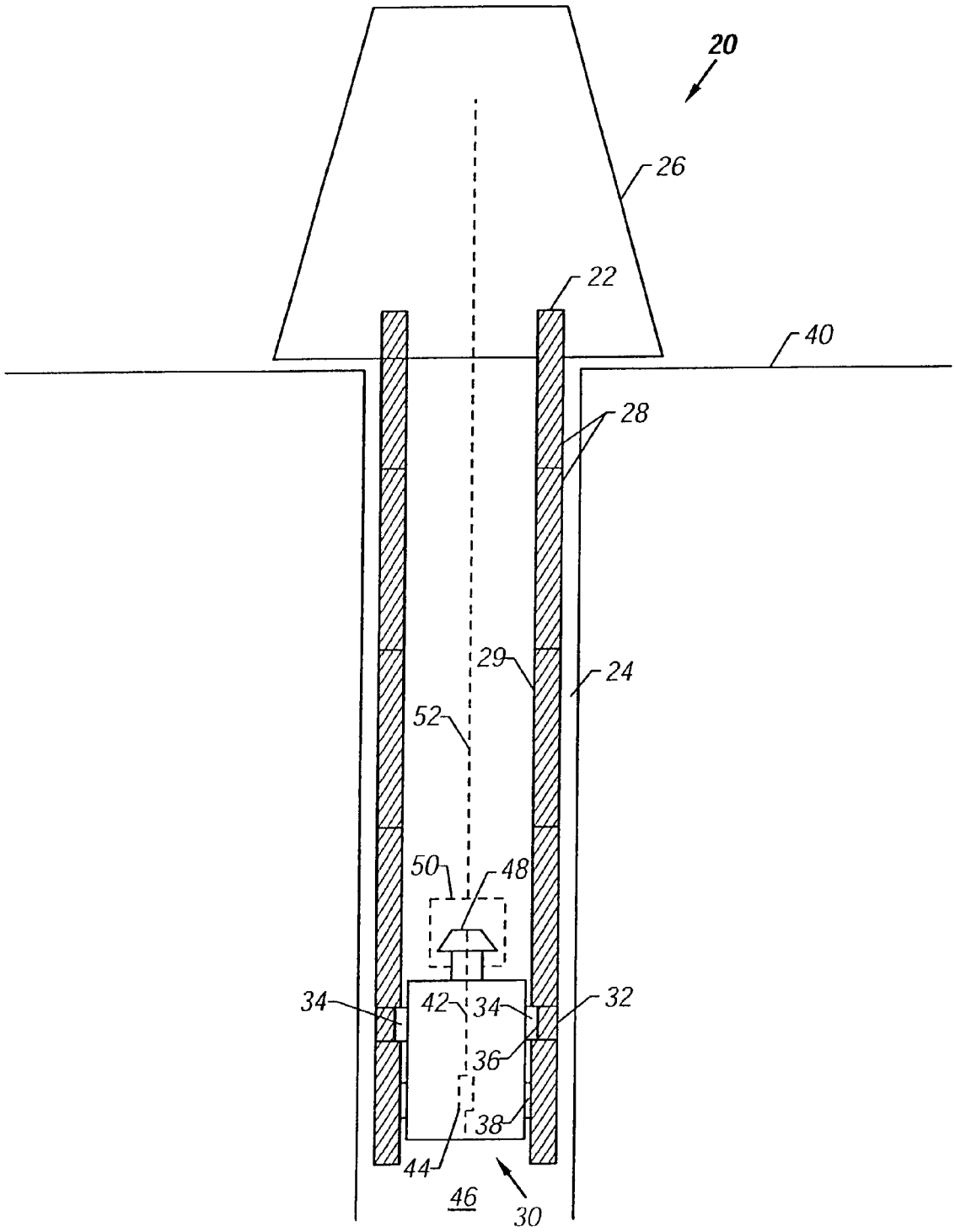
FIG. 1 is a front elevational view of a system for deploying casing and a blowout prevention device into a wellbore, according to a preferred embodiment of the present invention.

Referring generally to FIG. 1, a system 20 for deploying a casing string 22 into a wellbore 24 is featured. A rig system 26 is used to assemble casing joints 28 into casing string 22. Casing string 22 is lowered further into wellbore 24 as each new casing joint 28 is added to the casing string 22. Casing joints 28 are tubular and have a hollow interior 29. A retrievable check valve 30 is secured to a casing coupling 32 near the bottom of casing string 22. Casing coupling 32 may be a modified casing joint or a coupling joint used to connect two casing joints 28.

Retrievable check valve 30 is configured so that fluid may be pumped through hollow interior 29 and retrievable check valve 30. This allows fluid to be pumped down into casing string 22 to clean the interior of casing string 22, to compensate for fluid losses, to change the nature of the column of fluid in the casing string 22 and wellbore 24, etc. However, retrievable check valve 30 prevents fluid in wellbore 24 from flowing upward through the casing string 22. Thus, if there is an unbalanced pressure or a gas migration into the column of fluid, retrievable check valve 30 prevents well fluid from circulating to the surface inside the hollow interior 29 of casing string 22. Additionally, retrievable check valve 30 is configured such that it is secured to casing coupling 32 during the lowering of casing string 22 into wellbore 24. However, valve 30 is retrievable from casing string 22 once casing string 22 has reached its desired position in wellbore 24.

In the illustrated embodiment, retrievable check valve 30 has securing members 34 which engage a landing 36, or landings, on the inside surface of casing coupling 32 to secure retrievable check valve 30 to casing coupling 32. Landing 36 and securing members 34 may be configured in a variety of different configurations. Preferably, landing 36 is a recess in the interior surface of casing coupling 32 and securing members 34 are a plurality of keys configured for engagement with the recess.

Retrievable check valve 30 has a sealing member 38 that prevents fluid in wellbore 24, below retrieval check valve 30, from flowing between retrievable check valve 30 and casing string 22 towards the surface 40. However, an internal fluid path 42 and a check valve 44 allow fluid to be pumped from surface 40 through retrievable check valve 30 into a lower portion 46 of wellbore 24.

A retrieving member 48 is used to remove retrievable check valve 30 from casing string 22. A retrieval tool 50 is lowered onto retrieving member 48 from the surface. Retrieval tool 50 may be deployed in a variety of ways, such as by a wireline, production tubing, or coil tubing. In the illustrated embodiment, retrieval tool 50 is deployed by a wireline 52. If the well inclination creates difficulty in latching retrieval tool 50 onto retrieving member 48, a liquid may be used to pump down retrieval tool 50 towards retrievable check valve 30, as known to those of ordinary skill in the art.

To disengage retrievable check valve 30 from casing coupling 32 a pulling force is applied by, for example, wireline 52 to retrieval tool 50 and retrieving member 48. The pulling force applied to retrieving member 48 causes securing member 38 to retract from landing 36, freeing retrievable check valve 30 from casing coupling 32. Wireline 52 may then be used to raise retrievable check valve 30 to the surface 40. Casing string 22 provides full bore flow through hollow interior 29 once receivable check valve 30 is removed, because landing 36 is recessed into casing coupling 32. A bumper sub may be used to assist the retrieval tool 50 in raising retrievable check valve 30 to the surface.

Figure 2A:
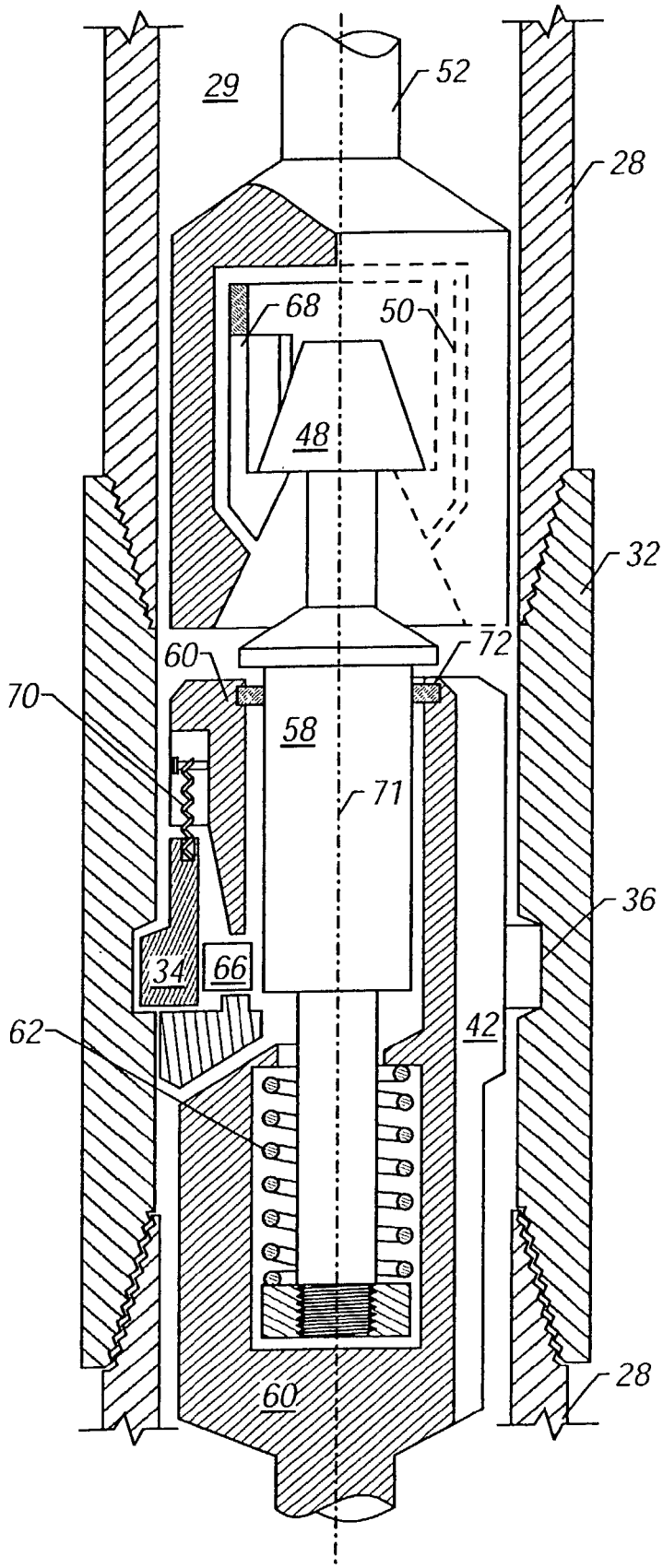
FIG. 2A is a front elevational view of a top portion of a retrievable check valve deployed near the bottom of a casing string, according to a preferred embodiment of the present invention.
Figure 2B:
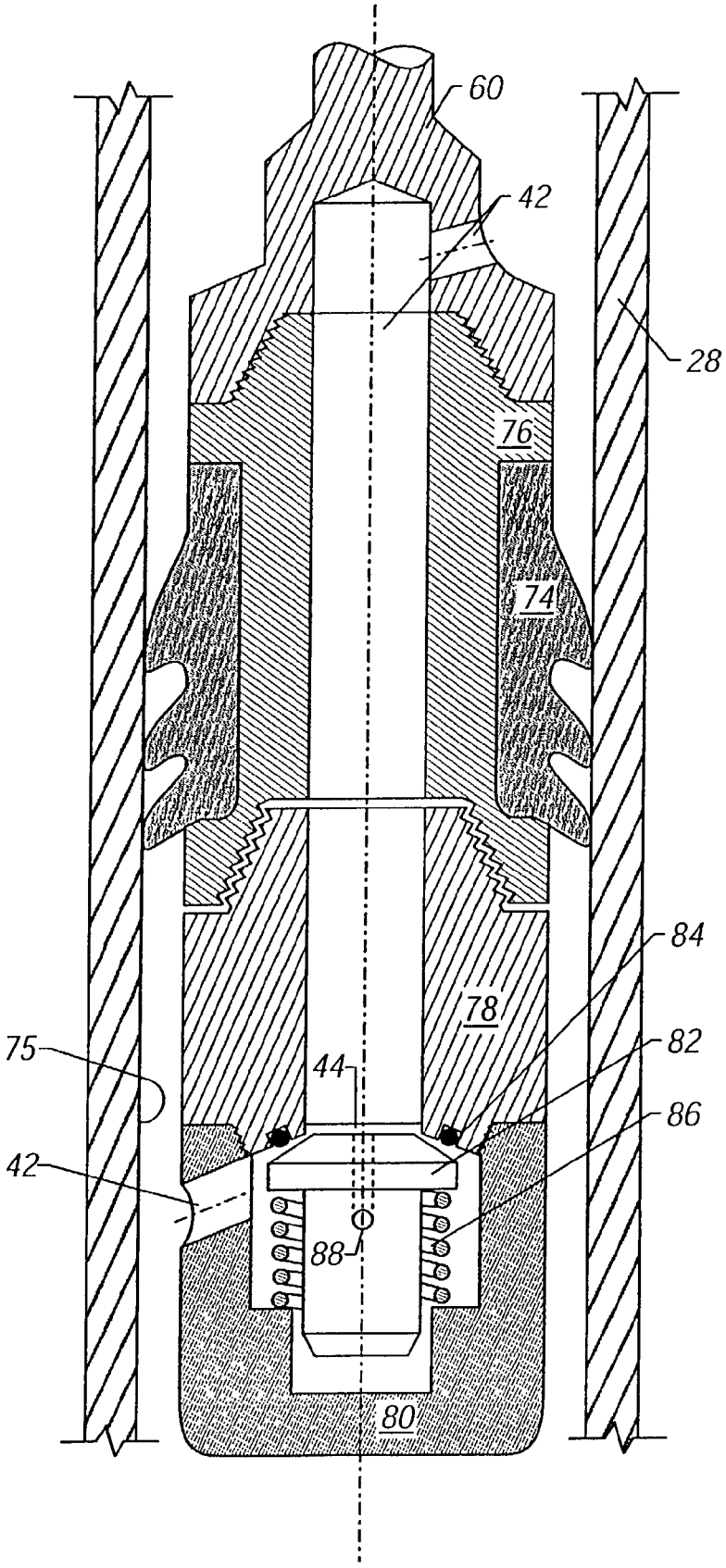
FIG. 2B is a front elevational view of a bottom portion of a retrievable check valve deployed near the bottom of a casing string, according to a preferred embodiment of the present invention.

Referring generally to FIGS. 2A and 2B, an exemplary embodiment of a retrievable check valve 30 is featured. Retrievable check valve 30 has a central mandrel 58 that extends through an upper portion 60 of retrievable check valve 30. Retrieving member 48 is coupled to, or formed from a portion of mandrel 58. In the illustrated embodiment, mandrel 58 is biased downward by a spring 62. A plurality of securing members 34 are held in landings 36 by engagement members 66. Engagement members 66 are held in position by mandrel 58.

Retrieval tool 50 has a snap-on latching assembly 68 that latches on to retrieving member 48. Retrieving member 48 and snap-on latching assembly 68 are configured for mating engagement with each other. A pulling force applied to retrieving member 48 by retrievable tool 50 will displace mandrel 58 from its initial position relative to upper portion 60. In the displaced position of mandrel 58, the engagement members 66 are no longer held in position by mandrel 58. One or more spring members 70 bias the securing members 34 toward a central axis 71. Spring members 70 operate to retract each securing member 34 from each landing 36 when engagement members 66 are no longer held in position by mandrel 58. Retrievable check valve 30 is then free to be transported to surface 40 by retrieval tool 50.

Alternatively, retrievable check valve 30 may be configured such that each securing member 34 is biased into a secured position against each corresponding landing 36. Thus, retrieving member 48 may be operated to overcome the bias to disengage securing member 34 from landing 36.

Retrievable check valve 30 also has a sealing member 72. Sealing member 72 is disposed between mandrel 58 and upper portion 60 to prevent wellbore fluid from entering and damaging the internal components of retrievable check valve 30.

Referring generally to FIG. 2B, the lower portion of retrievable check valve 30 is featured. A seal assembly, such as a multi-cup seal assembly 74 is used to form a seal between the retrievable check valve 30 and the interior surface 75 of the casing string 22. Multi-cup seal assembly 74 comprises a series of rubber discs oriented to naturally oppose the upward flow of fluid. Multi-cup seal assembly 74 is secured to a core section 76 of retrievable check valve 30. Core section 76 is secured to upper portion 60 and a lower portion 78 of retrievable check valve 30 by, for example, threaded engagement. Lower portion 78 is, in turn, coupled to a base portion 80 disposed generally opposite core section 76 as illustrated.

Fluid path 42 provides a path for fluid to bypass multi-cup seal assembly 74. Flow path 42 extends through upper portion 60, core section 76, lower portion 78, and bottom portion 80. Check valve 44 is disposed in bottom portion 80. Check valve 44 allows fluid to flow from the surface 40 through flow path 42 to the lower portion 46 of wellbore 24. Additionally, check valve 44 prevents fluid from flowing from the lower portion 46 of wellbore 24 through flow path 42 to the surface 40, thus preventing a blowout.

Check valve 44 may be configured in a variety of ways, such as with a ball or flapper valve. In the illustrated embodiment, check valve 44 comprises a valve disc 82 biased against a valve seat 84 by a spring 86. Check valve 44 includes a hole 88 for static pressure equalization across valve disc 82 to prevent the valve from opening inadvertently due to a pressure differential across valve disc 82.

When fluid is pumped down into casing string 22, the fluid can be sufficiently pressurized to overcome the force of spring 86 and to unseat valve disc 82 from valve seat 84. This provides a flow path for fluid from surface 40 into wellbore 24. Contrariwise, fluid pressure in lower portion 46 of wellbore 24 acts to further seat valve disc 82 against valve seat 84, unless overcome by fluid pressure applied above valve 44.

Figures 3, 3A:
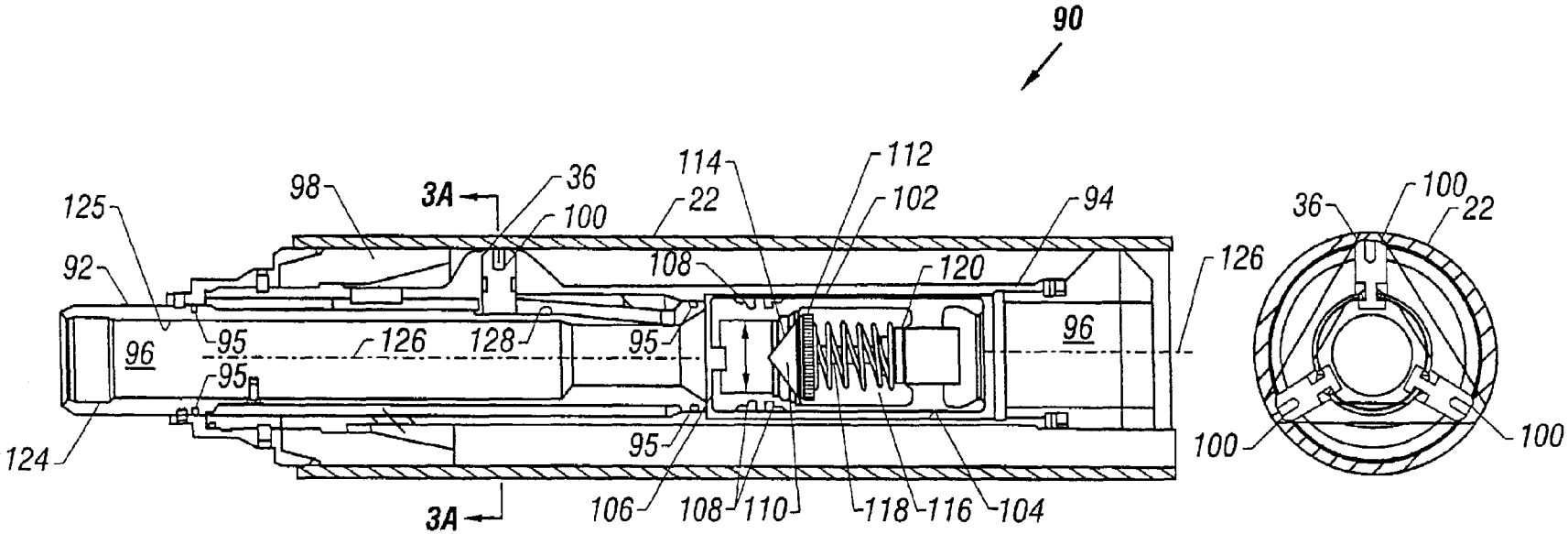
FIG. 3 is an alternate embodiment of a check valve assembly for deployment with a casing to prevent a blowout.
FIG. 3A is a cross-sectional view taken along line 3A—3A of FIG. 3.

Referring generally to FIGS. 3 and 3A, an alternate embodiment of a retrievable check valve 90 is featured. In this embodiment, retrievable check valve 90 comprises a mandrel 92 disposed within a body 94. O-rings 95 are used to form a seal between mandrel 92 and body 94. Fluid pumped from surface 40 is directed through a flow channel 96 that extends through mandrel 92 and body 94. A swab cup 98 is used to form a seal between retrievable check valve 90 and casing string 22. In the illustrated embodiment, retrievable check valve 90 is secured to casing string 22 by key plungers 100, e.g., three key plungers. The three key plungers 100 are seated into three corresponding landing profiles 36 on casing coupling 32.

A check valve assembly 102 is disposed within a central cavity 104 of retrievable check valve 90 to prevent fluid from flowing through flow channel 96 to surface 40. Check valve 102 has a number of components assembled within a structural member 106. Side seals 108 are disposed on the exterior of structural member 106 to form a seal between check valve 102 and the inner surface defining cavity 104. Check valve 102 includes a valve disc 110 and a valve seal 112. Valve 110 and valve seal 112 are biased against a surface 114 by a spring 116. A valve guide 118 is used to direct a movement of valve 110 and valve seal 112. Spring 116 is secured to valve 110 by a valve seal disk 120.

A retrieval tool 50 may be lowered or pumped down to secure tool 50 to a nipple profile 124 extending circumferentially around the interior surface 125 of mandrel 122. A pulling force is applied to mandrel 92 to draw mandrel 92 upward to release the three key plungers 100 from landing profile 36. During upward movement, the three key plungers 100 are biased towards the central axis 126 of retrievable check valve 90. In the secured position, the three key plungers are held in place by mandrel 92. Mandrel 92 is configured with an angled portion 128. Angled portion 128 allows the biasing element to retract the three key plungers 100 towards axis 126 and out of landing profile 36, releasing retrievable check valve 90 from the casing string 22. Retrieval tool 50 is then used to raise check valve assembly 102 to the surface.

Figure 4:
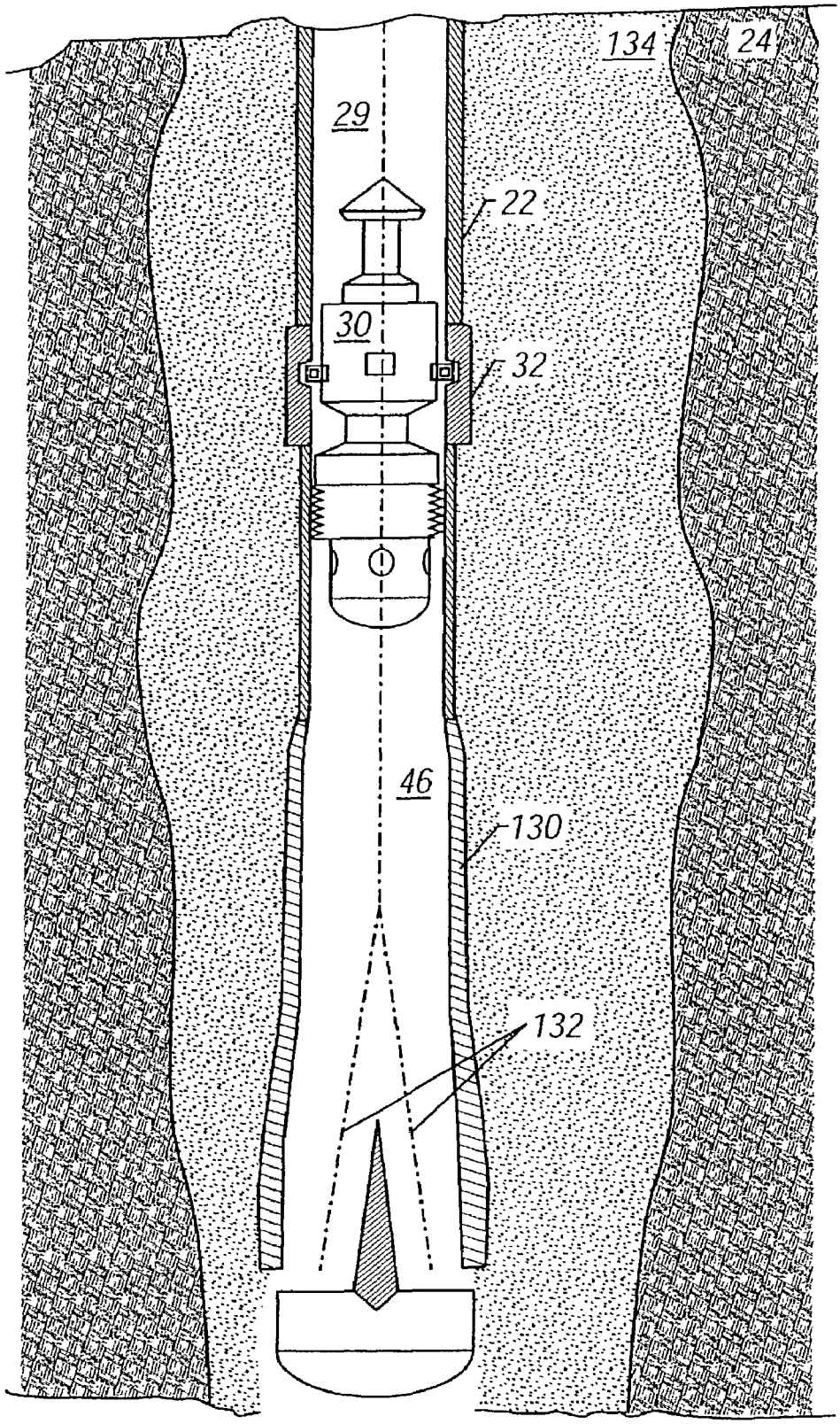
FIG. 4 is a front elevational view of a system for deploying a multi-branch junction at the end of a casing string having a retrievable check valve to prevent a blowout.

Referring generally to FIG. 4, a system is featured for preventing a well blowout as a casing string 22 and a multi-branch junction 130 are lowered into a wellbore. The multi-branch junction 130 is secured to the lower end of casing string 22. A retrievable check valve 30 is secured within casing string 22 in proximity to the multi-branch junction 130. In the illustrated embodiment, multi-branch junction 130 merges fluid flow from two fluid flow paths 132. However, multi-branch junction 130 may be used to merge more than two fluid flow paths. Retrievable check valve 30 prevents wellbore fluid 134 from entering casing string 22 through multi-branch junction 130 and flowing up through the hollow interior 29 of casing string 22 to the surface.

It will be understood that the foregoing description is of preferred embodiments of this invention, and that the invention is not limited to the specific forms shown. For example, a variety of mechanisms may be used to retrieve the retrievable check valve, such as a wireline, production tubing, or coil tubing. Additionally, the sealing member may be above or below the securing member in the wellbore. Furthermore, fluid may flow through a single fluid channel in the retrievable check valve or multiple fluid channels. These and other modifications may be made in the design and arrangement of the elements without departing from the scope of the invention as expressed in the appended claims. Also, it is the intention of the applicant not to involve 35 U.S.C. §112, paragraph 6 for limitations of any of the claims herein, except for those in which the claim expressly uses the words "means for" together with an associated function.

What is claimed is:

1. A well completion string, comprising:

a casing string deployed within a wellbore and having a multilateral junction, the multilateral junction comprising a junction of at least two flow branches; and a check valve coupled within the casing string above the multilateral junction for movement into the wellbore with the casing string, the check valve being configured to enable downward flow of fluid, the check valve further being configured for static pressure equalization while coupled within the casing string, wherein the check valve is selectively retrievable from the wellbore to a surface location.

2. The well completion string as recited in claim 1, wherein the check valve comprises a latch, the latch being operable to release the check valve from the casing string.

3. The well completion system as recited in claim 2, wherein the latch is operable by a retrieval tool extending from the surface.

4. A system, comprising:

a casing string having a multilateral junction, the casing string being deployed downhole; and a check valve assembly securable to the casing string at a position above the multilateral junction for movement downhole with the casing string, the check valve assembly preventing fluid from flowing upward through the casing string, the check valve assembly further having a static pressure equalization mechanism to prevent inadvertent opening of the check valve assembly while the check valve assembly is secured to the casing string, wherein the check valve assembly may selectively be released from the casing string to transport the check valve assembly to a surface location.

5. The system as recited in claim 4, wherein the check valve assembly allows fluid to flow downwardly through the check valve assembly from the surface location.

6. The system as recited in claim 4, further comprising:

a retrieval device, the retrieval device being operable to retrieve the retrievable check valve from the casing string.

7. The system as recited in claim 6, wherein the retrieval device is coupleable to a wireline.

8. The system as recited in claim 6, wherein the retrieval device is coupleable to a tubing.

9. The system as recited in claim 4, wherein the casing string comprises a casing coupling configured for engagement with the check valve assembly.

10. The system as recited in claim 9, wherein the casing coupling is configured with a recess in an interior surface and the check valve assembly comprises a securing member configured for engagement with the recess.

11. The system as recited in claim 10, further comprising:

a mechanism operable by the retrieval tool to disengage the securing member from the casing string.

12. The system as recited in claim 4, wherein the check valve assembly comprises:

a housing;

a check valve disposed within the housing; and a sealing member configured to form a seal between the housing and an interior surface of the casing string or casing coupling.

13. A method of deploying casing into a wellbore, comprising:

securing a blowout prevention assembly to a casing string having a multilateral junction;

providing the blowout prevention assembly with a static pressure equalization mechanism to prevent inadvertent opening of the blowout prevention assembly while it is secured to the casing string;

deploying the casing string in a wellbore with the multilateral junction leading the blowout prevention assembly; and retrieving the blowout prevention assembly from the casing string after the casing string is deployed.

14. The system as recited in claim 13, wherein securing comprises configuring the casing string with a casing coupling.

15. The method as recited in claim 13, wherein securing comprises configuring the blowout prevention assembly with a check valve oriented to enable fluid to be pumped downward from the surface through the casing string and the multilateral junction.

16. The method as recited in claim 13, wherein retrieving comprises deploying a retrieval tool to release the blowout prevention assembly from the casing coupling.

17. The method as recited in claim 13, wherein retrieving comprises providing a pulling force to the blowout prevention assembly to disengage the retrieval tool from the coupling member.

* * * * *